US005967263A

United States Patent [19]

Ariga

[11] Patent Number: 5,967,263

[45] Date of Patent: Oct. 19, 1999

[54] CHECK-OUT COUNTER ACCESSIBLE TO DISABLED PERSONS

[75] Inventor: Isao Ariga, Kawasaki, Japan

[73] Assignee: Fujitsu Limited, Kawasaki, Japan

[21] Appl. No.: 08/986,639

[22] Filed: Dec. 8, 1997

[30] Foreign Application Priority Data

Jul. 1, 1997 [JP] Japan ..... 9-176102

[51] Int. Cl.[6] ..... A63F 9/02; A47B 96/18

[52] U.S. Cl. ..... 186/59; 312/140.4

[58] Field of Search ..... 186/59, 60, 61, 186/62, 63, 64, 65, 66, 67, 68, 69, 37; 312/140.4

[56] References Cited

U.S. PATENT DOCUMENTS 4,138,000 2/1979 Hartup ..... 186/59

4,618,032 10/1986 Woolf ..... 186/61

4,838,383 6/1989 Saito et al. ..... 186/59

*Primary Examiner*—Christopher P. Ellis

*Assistant Examiner*—Bryan Jaketic

*Attorney, Agent, or Firm*—Armstrong, Westerman, Hattori, McLeland & Naughton

[57] ABSTRACT

A check-out counter includes a side frame which has an entrance-side end and an exit-side end. A top plate is provided on the side frame and has a longitudinal direction. An accounting terminal is provided on the top plate. The top plate comprises a first end surface at the entrance-side end, a second end surface extending in the longitudinal direction from the entrance-side end to the exit-side end, and a circular rounded corner provided between the first end surface and the second end surface. The corner confronts an entrance part of an access lane related to the check-out counter and has a radius large enough for a customer to avoid interference with the corner when entering the access lane.

20 Claims, 7 Drawing Sheets

CHECK-OUT COUNTER ACCESSIBLE TO DISABLED PERSONS

BACKGROUND OF THE INVENTION (1) Field of the Invention

The present invention relates to check-out counters which are used in stores such as supermarkets for check-out of merchandise bought by customers.

Existing check-out counters, installed in stores such as supermarkets, are designed for physically normal customers only. Recently, stores such as supermarkets are on the way to improvements of convenience for physically disabled persons in wheelchairs. There is a demand for an improved check-out counter which enables the physically disabled persons to get easy access to the check-out counter.

(2) Description of the Related Art

FIG. 1 shows a conventional check-out counter 10. As shown in FIG. 1, the conventional check-out counter 10 generally has a side frame 11, a rectangular top plate 12 on the side frame 11, and an accounting terminal 13, such as a POS (point-of-sale) terminal, on the top plate 12.

The conventional check-out counter 10 is designed for normal customers only, not for physically disabled persons. The top plate 12 has a square corner 12*a* located near an entrance part of an access lane related to the check-out counter 10. The square corner 12*a* is slightly rounded so as to prevent the customer from being injured when the customer hits the corner 12*a*. The side frame 11 has a side surface 11*a* located adjacent to the access lane, and the top plate 12 has a side end surface 12*b* adjacent to the access lane. The side surface 11*a* is flat and parallel with the side end surface 12*b* of the top plate 12. The side surface 11*a* and the side end surface 12*b* are substantially flush with respect to a horizontal direction.

FIG. 2A and FIG. 2B show an arrangement of a conventional check-out facility using the conventional check-out counter 10 of FIG. 1.

The conventional check-out facility using the check-out counter 10 is usually arranged in a building as shown in FIG. 2A. This arrangement allows for use by the normal customers only. The check-out counter 10 is separated from a wall of the building, and an access lane 16 having a width W1 is provided between the check-out counter 10 and the wall of the building. The width W1 of the lane 16 is set at a width that is adequate for a normal customer 20 to pass through the lane 16 without interference with the check-out counter 10.

In order to enable a physically disabled person 22 in a wheelchair 21 to get easy access to the check-out counter 10, the conventional check-out facility using the check-out counter 10 must be arranged as shown in FIG. 2B. In the conventional check-out facility of FIG. 2B, the check-out counter 10 is separated from a wall of the building, and a wide access lane 17 having a width W2 greater than the width W1 is provided between the check-out counter 10 and the wall of the building. As the conventional check-out counter 10 is not designed for physically disabled persons in wheelchairs, the width W2 of the lane 17 to which the conventional check-out counter 10 is installed must be greater than a width of the wheelchair 21 by about 200 mm. The difference (about 200 mm) between the width W2 of the lane 17 and the width of the wheelchair 21 is called a margin width.

Generally, for many stores such as supermarkets, an internal area of a respective store where a plurality of check-out counters are installed is limited. If the check-out facility as shown in FIG. 2B, which allows easy access by the physically disabled persons, is placed in the internal area of such a store, the number of check-out counters 10 installed therein has to be reduced to a number smaller than the number of check-out counters 10 installed as shown in FIG. 2A.

On the other hand, the conventional check-out counter 10 is designed for normal customers only, and it is inconvenient to the disabled person 22 in the wheelchair 21 in several points. For example, the disabled person 22 in the wheelchair 21 must take a circuitous course, as indicated by a line 25 in FIG. 2B, when entering the access lane 17, such that the wheelchair 21 does not interfere with the corner 12*a* of the check-out counter 10. It is inconvenient to the disabled person 22 to put a shopping bag on the top plate 12 from a position of the wheelchair 21. It is not easy for the disabled person 22 to see a customer display of the accounting terminal 13 from the position of the wheelchair 21. It is also difficult for the disabled person 22 to place money on or receive change from a cash container above the top plate 12 of the check-out counter 10.

SUMMARY OF THE INVENTION

An object of the present invention is to provide an improved check-out counter in which the above-mentioned problems are eliminated.

Another object of the present invention is to provide a check-out counter which provides increased accessibility for physically disabled persons in wheelchairs.

Still another object of the present invention is to provide a check-out counter which provides increased convenience to physically disabled persons in wheelchairs.

The above-mentioned objects of the present invention are achieved by a check-out counter comprising: a side frame which has an entrance-side end and an exit-side end; a top plate, provided on the side frame, which has a longitudinal direction; and an accounting terminal provided on the top plate, wherein the top plate comprises a first end surface at the entrance-side end, a second end surface extending in the longitudinal direction from the entrance-side end to the exit-side end and a circular rounded corner provided between the first end surface and the second end surface, wherein the corner confronts an entrance part of an access lane related to the check-out counter and has a radius large enough for a customer to avoid interference with the corner when entering the access lane.

The above-mentioned objects of the present invention are achieved by a check-out counter comprising: a side frame which has an entrance-side end and an exit-side end; a top plate, provided on the side frame, which has a longitudinal direction and comprises an end surface extending in the longitudinal direction from the entrance-side end to the exit-side end; and an accounting terminal provided on the top plate, wherein the side frame comprises a first side surface at the entrance-side end, a middle side surface and a second side surface at the exit-side end, the middle side surface being substantially flush with the end surface of the top plate with respect to a horizontal direction perpendicular to the longitudinal direction, the middle side surface being parallel with the end surface of the top plate, the first side surface being inwardly inclined with respect to the longitudinal direction to extend slantwise from an inward position at the entrance-side end of the side frame to an entrance-side end of the middle side surface, the second side surface being inwardly inclined with respect to the longitudinal direction to extend slantwise from an exit-side end of the middle side surface to an inward position at the exit-side end of the side frame.

The check-out counter of the present invention is effective in providing increased accessibility for physically disabled persons in wheelchairs. It is not necessary for the disabled persons in wheelchairs to take a circuitous course in order to avoid interference with the corner of the check-out counter when entering the access lane. Further, the check-out counter of the present invention is effective in providing increased convenience to disabled persons in wheelchairs. For example, when the disabled person in a wheelchair approaches the check-out counter of the present invention, it is possible for the wheelchair to be beneath the top plate and allow the disabled person to come closer to the check-out counter. The disabled person can easily put a shopping bag on the top plate from the position of the wheelchair. The check-out counter of the present invention makes it possible to provide an effective space for a disabled person in a wheelchair to the access lane and allow for the wheelchair to easily enter or leave the access lane without interference with the check-out counter. The check-out counter of the present invention enables a disabled person in a wheelchair to easily see the customer display of the accounting terminal and easily use the cash container of the accounting terminal from the wheelchair.

BRIEF DESCRIPTION OF THE DRAWINGS

The above and other objects, features and advantages of the present invention will become more apparent from the following detailed description when read in conjunction with the accompanying drawings in which.

DESCRIPTION OF THE PREFERRED EMBODIMENTS

A description will now be given of the preferred embodiments of the present invention with reference to the accompanying drawings.

Figure 3:
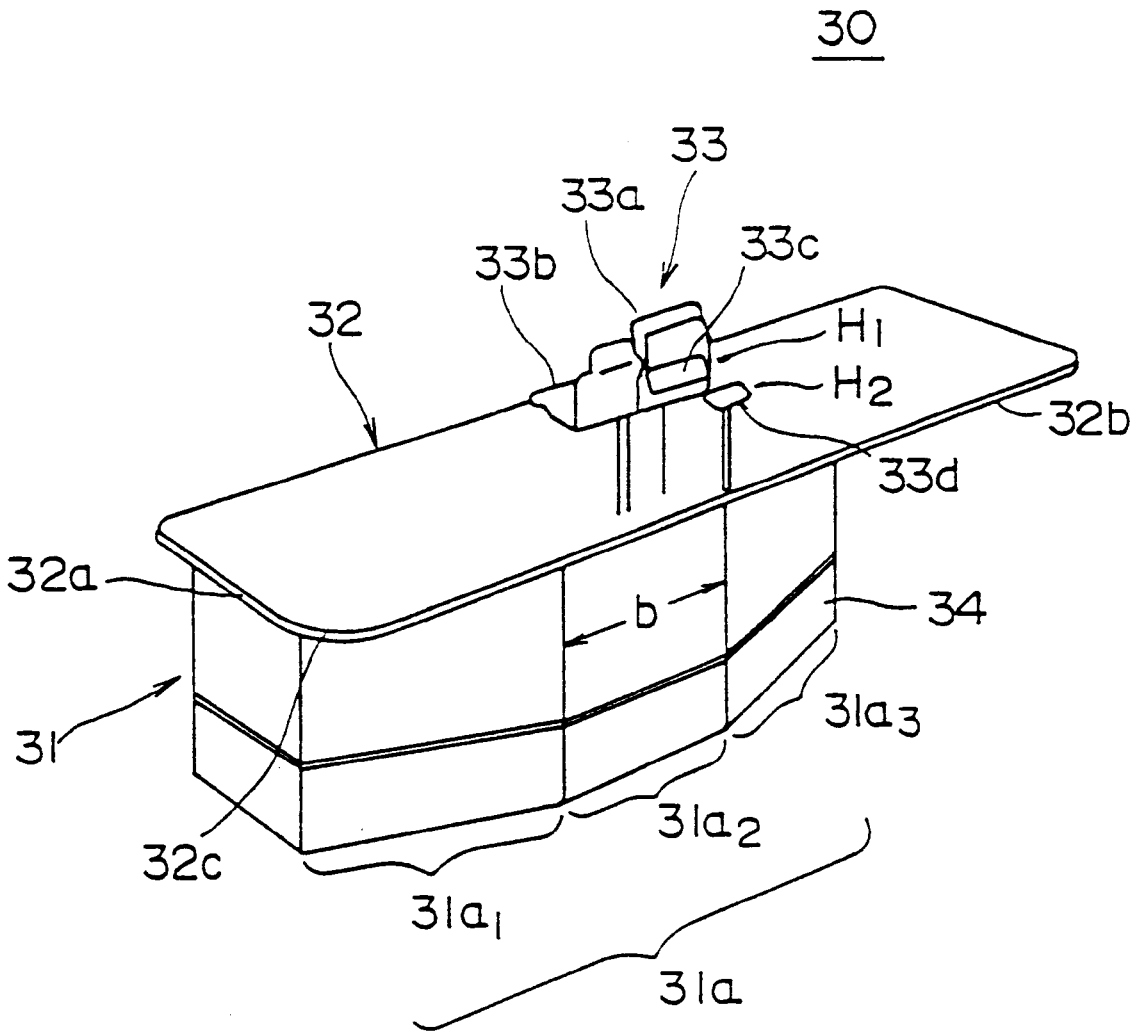
FIG. 3 is a perspective view of a first embodiment of a check-out counter of the present invention.
Figure 4A:
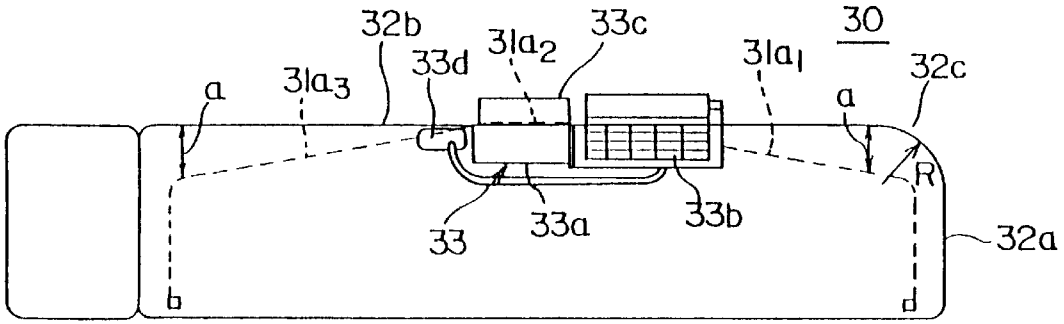
FIG. 4A, FIG. 4B and FIG. 4C are top, front and side views of the check-out counter of FIG. 3.
Figure 4B:
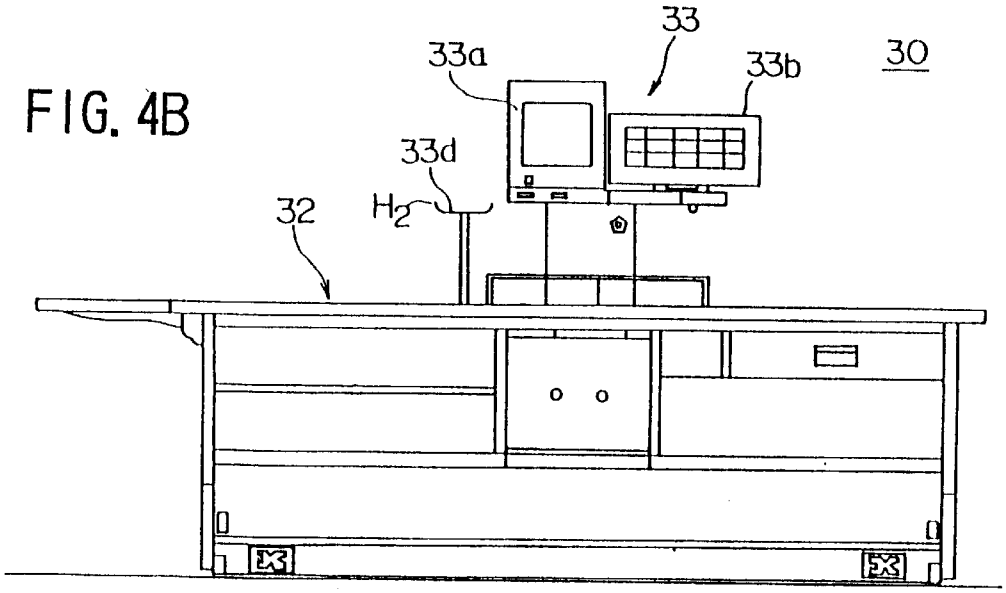
Figure 4C:
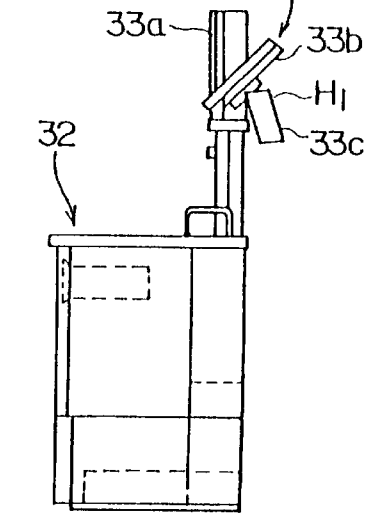

FIG. 3 shows a first embodiment of the check-out counter of the present invention. FIG. 4A, FIG. 4B and FIG. 4C are top, front and side views of the check-out counter of FIG. 3.

As shown in FIG. 3 through FIG. 4C, the check-out counter 30 of the present embodiment comprises a side frame 31, a rectangular top plate 32 on the side frame 31, and an accounting terminal 33, such as a POS (point-of-sale) terminal, on the top plate 32. In the following, a configuration of the check-out counter 30 of the present invention which allows for easy access and increased convenience of physically disabled persons in wheelchairs will be described.

In the check-out counter 30 of the present embodiment, the side frame 31 has an entrance-side end where a customer enters an access lane related to the check-out counter 30, and an exit-side end where the customer leaves the access lane. The top plate 32 includes a first end surface 32*a* located at the entrance-side end of the side frame 31. The top plate 32 includes a second end surface 32*b* extending in a longitudinal direction of the check-out counter 30. The top plate 32 includes a circular rounded corner 32*c* confronting an entrance part of the access lane, and the corner 32*c* interconnects the first end surface 32*a* and the second end surface 32*b*. The corner 32*c* in the present embodiment has a radius "R" of about 20 cm as shown in FIG. 4A.

The circular rounded corner 32*c* of the top plate 32 confronts an entrance part of the access lane and has a radius "R" that is large enough for a physically disabled person in a wheelchair to avoid interference with the corner 32*c* of the check-out counter 30 when entering the access lane. Because of the use of the corner 32*c* in the top plate 32, it is not necessary for a disabled person in a wheelchair to take a circuitous course, as indicated by the line 25 in FIG. 2B. The check-out counter 30 is effective in providing increased accessibility for a disabled person in a wheelchair.

The top plate 32 in the check-out counter 30 is at a position which is slightly higher than a position of the wheelchair, and the wheelchair can be placed beneath or pass under the top plate 32.

In the check-out counter 30 of the present embodiment, the side frame 31 has a side portion 31*a* located adjacent to the access lane. The side portion 31*a* includes a first side surface 31*a*1 located at the entrance-side end of the side frame 31, a middle side surface 31*a*2, and a second side surface 31*a*3 located at the exit-side end of the side frame 31.

The middle side surface 31*a*2 is substantially flush with the second end surface 32*b* of the top plate 32 with respect to a horizontal direction as shown in FIG. 4A. The middle side surface 31*a*2 and the second end surface 32*b* are parallel with each other. The middle side surface 31*a*2 extends in the longitudinal direction of the counter 30 and has a width "b" in the longitudinal direction of the counter 30 as shown in FIG. 3.

The first side surface 31*a*1 is inwardly inclined with respect to the longitudinal direction of the counter 30 to extend slantwise from an inward position at the entrance-side end of the side frame 31 to an entrance-side end of the middle side surface 31*a*2 as shown in FIG. 4A. A distance between the second end surface 32*b* and the inward position at the entrance-side end of the side frame 31 in a horizontal direction perpendicular to the longitudinal direction of the counter 30 is indicated by "a" in FIG. 4A.

The second side surface 31*a*3 is inwardly inclined with respect to the longitudinal direction of the counter 30 to extend slantwise from an exit-side end of the middle side surface 31*a*2 to an inward position at the exit-side end of the side frame 31 as shown in FIG. 4A. A distance between the second end surface 32*b* and the inward position at the exit-side end of the side frame 31 in the horizontal direction is indicated by "a" in FIG. 4A.

As shown in FIG. 4A, the first side surface 31*a*1 and the second side surface 31*a*3 are substantially symmetrical with respect to a center position of the middle side surface 31*a*2. The distance "a" for each of the entrance-side end and the exit-side end of the side frame 31 in the present embodiment is set at about 20 cm.

As described above, the middle side surface 31*a*2 has the width "b" in the longitudinal direction of the counter 30 and it is flat and parallel with the second end surface 32*b* of the top plate 32. Thus, the middle side surface 31*a*2 extends in parallel to the access lane related to the check-out counter 30. When a disabled person in a wheelchair passes through the access lane, this configuration of the side frame 31 helps the disabled person visually check if the width of the access lane at the position of the middle side surface 31*a*2 is adequate for the wheelchair to pass through the access lane. The check-out counter 30 of the present embodiment provides increased convenience to physically disabled persons in wheelchairs.

As shown in FIG. 3, in the check-out counter 30 of the present embodiment, a rubber guard 34 is provided at a lower half of the side portion 31*a* of the side frame 31, and the rubber guard 34 extends along the entire periphery of the lower half of the side portion 31*a*. The rubber guard 34 is at a position that is level with or in conformity with the position of the wheelchair. The rubber guard 34 protects both the check-out counter 30 and the wheelchair from damage if the wheelchair hits the side frame 31 of the check-out counter 30.

In the check-out counter 30 of the present embodiment, the accounting terminal 33 includes a bar-code scanner 33*a*, a multiple-item keyboard 33*b*, a customer display 33*c*, and a cash container 33*d*. The bar-code scanner 33*a* reads a bar code of merchandise by optically scanning it. The keyboard 33*b* is used by a check-out operator to perform input operations. The customer display 33*c* displays an amount charged the customer for the merchandise.

The customer display 33*c* in the present embodiment is at a position "H1" that is lower than a position of the customer display in the conventional check-out counter 10. The position H1 of the customer display 33*c* in the check-out counter 30 is in conformity with the position of a disabled person in a wheelchair. Thus, the disabled person in the wheelchair can easily see the customer display 33*c* of the accounting terminal 33 from the wheelchair.

The cash container 33*d* in the present embodiment is at a position "H2" that is lower than a position of the cash container in the conventional check-out counter 10. The position H2 of the cash container 33*d* in the check-out counter 30 is in conformity with the position of a disabled person in a wheelchair. Thus, the disabled person in the wheelchair can easily place money on or receive change from the cash container 33*d* in the check-out counter 30.

Figure 5:
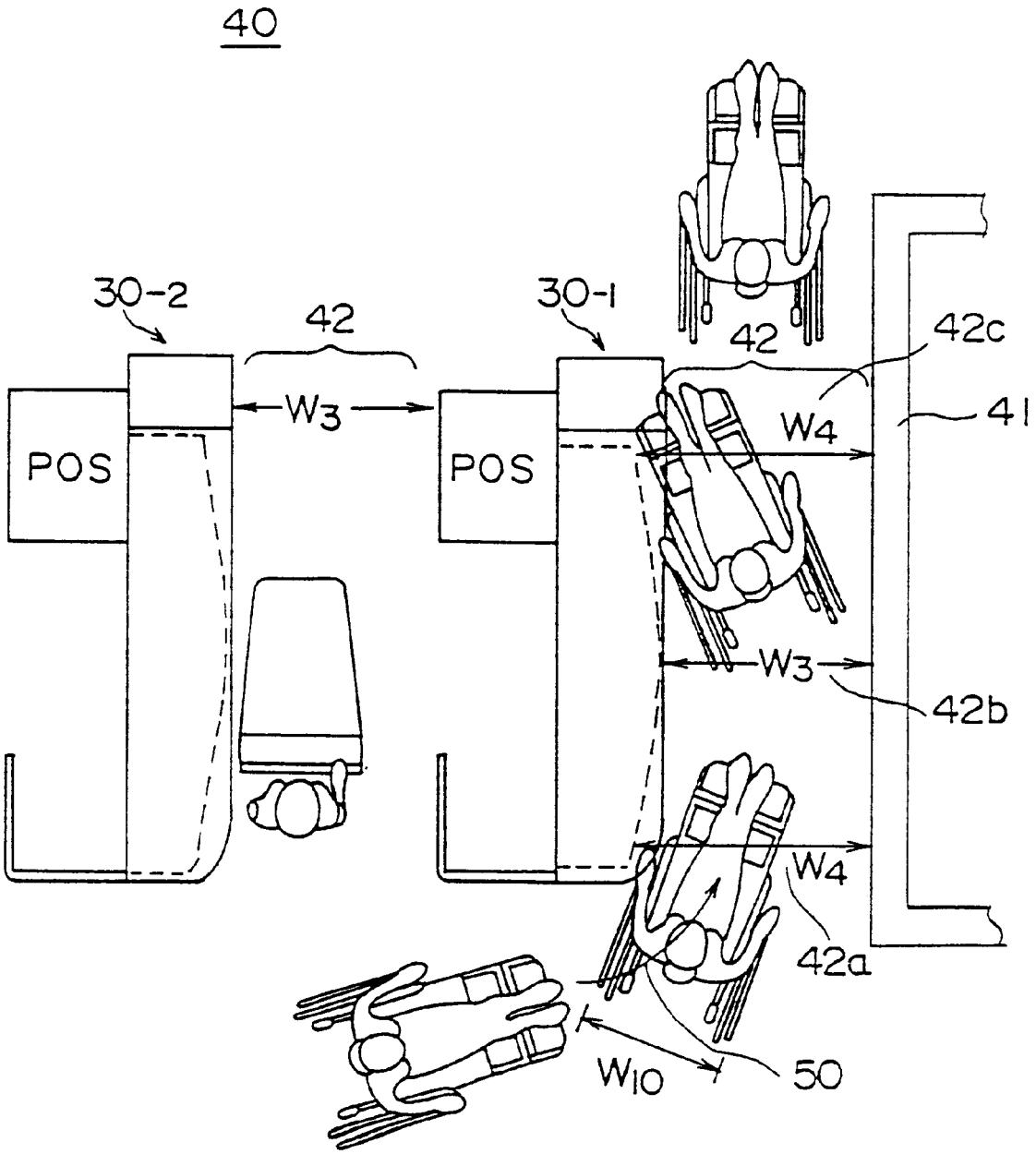
FIG. 5 is a diagram for explaining an arrangement of a check-out facility using the check-out counter of FIG. 3.

FIG. 5 shows an arrangement of a check-out facility 40 using the check-out counter 30 of FIG. 3. As shown in FIG. 5, in the check-out facility 40, a check-out counter 30-1 and a check-out counter 30-2 are arranged in an internal area of a store such as a supermarket. An access lane 42 between the check-out counters 30-1 and 30-2 and an access lane 42 between the check-out counter 30-1 and a wall 41 of the store building are provided, and these lanes 42 have a width "W3" as indicated in FIG. 5.

Figure 1:
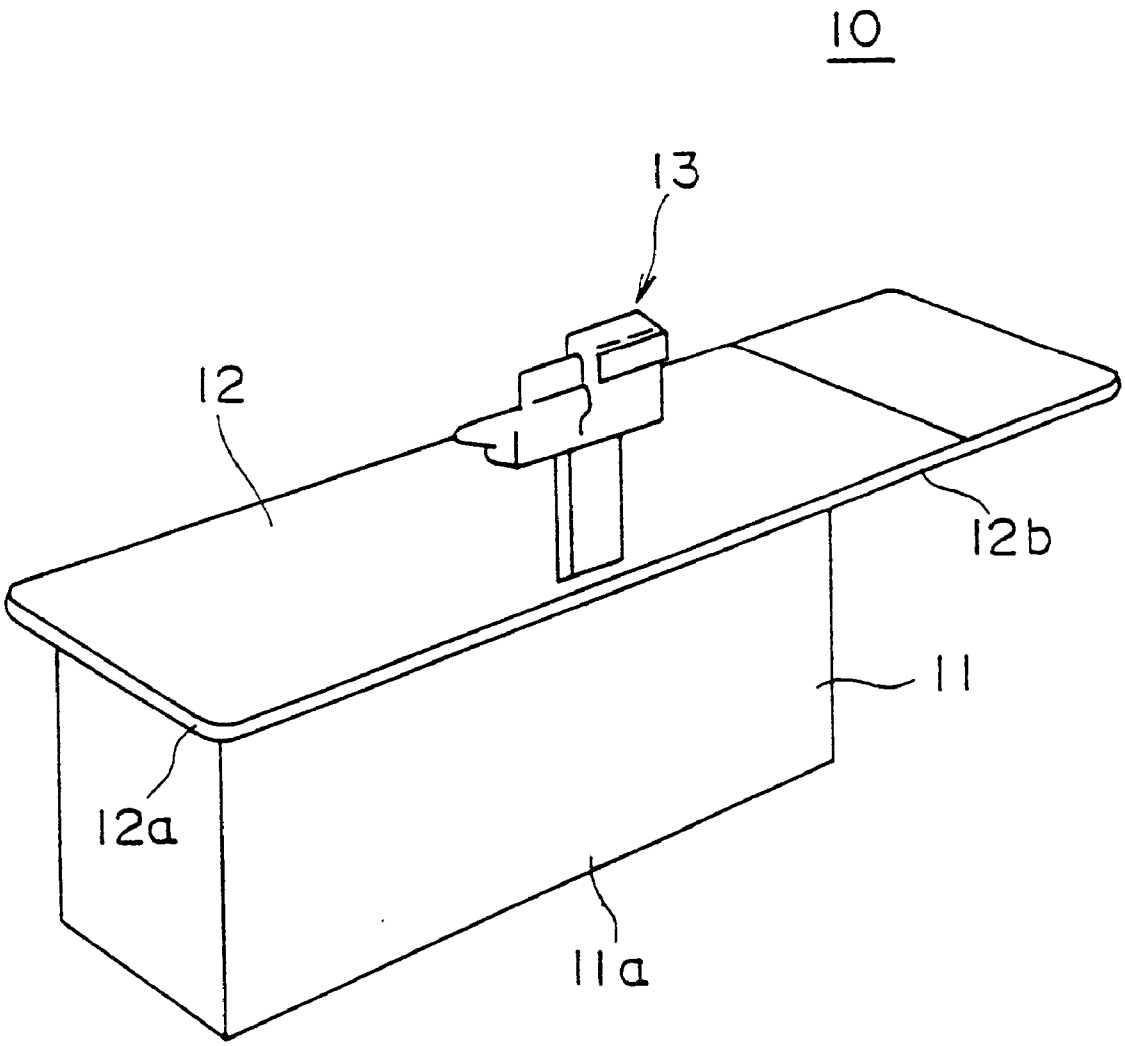
FIG. 1 PRIOR ART
FIG. 1 is a perspective view of a conventional check-out counter.
Figure 2A:
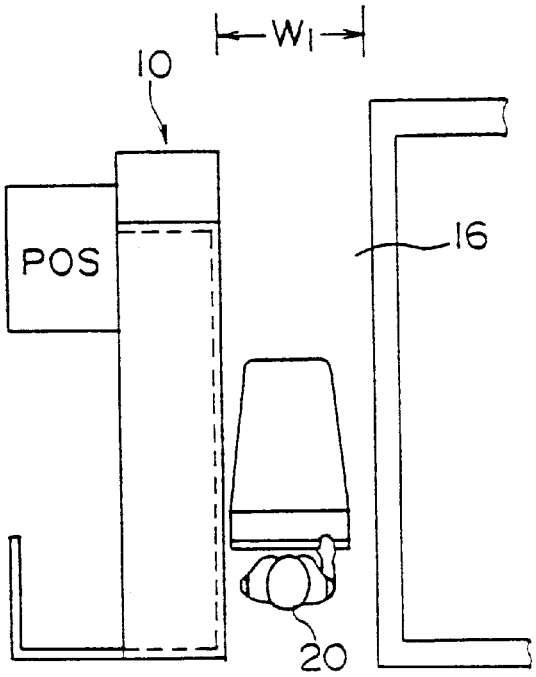
FIG. 2A PRIOR ART
FIG. 2A and FIG. 2B are diagrams for explaining an arrangement of a conventional check-out facility using the conventional check-out counter of FIG. 1.
Figure 2B:
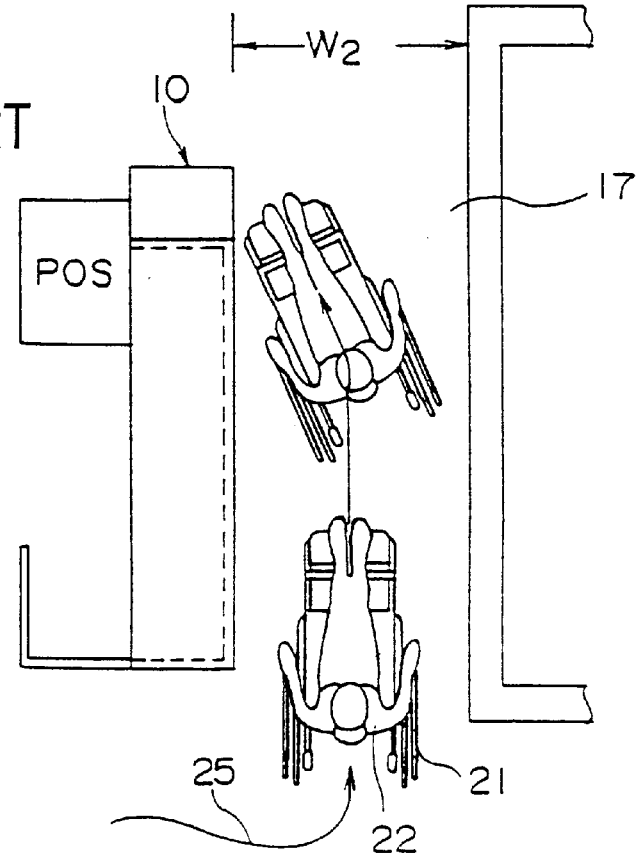
FIG. 2B PRIOR ART

As described above, the check-out counter 30 of the present embodiment allows for easy access and increased convenience for physically disabled persons in wheelchairs. The width W3 of the access lane 42 is smaller than the width W2 of the access lane 17 in the conventional check-out facility of FIG. 2B, although it is greater than the width W1 in the conventional check-out facility of FIG. 2A. It is possible to make the number of check-out counters 30 installed, as in the check-out facility of FIG. 5, greater than the number of the check-out counters 10 installed, as shown in FIG. 2B, when it is assumed that both the counters 30 and 10 are placed in the same internal area of the same store.

Further, the top plate 32 in the check-out counter 30 of the present embodiment is at a position slightly higher than the position of the wheelchair, and the wheelchair can be placed beneath or pass under the top plate 32 at the entrance-side end of the side frame 31 and at the exit-side end thereof. Therefore, a movable range of the wheelchair in which the wheelchair is movable on or in the access lane 42 with respect to the check-out counter 30 is increased.

More specifically, as shown in FIG. 5, the access lane 42 related to the check-out counter 30-1 includes a first portion 42*a* corresponding to the first side surface 31*a*1, a middle portion 42*b* corresponding to the middle side surface 31*a*2, and a second portion 42*c* corresponding to the second side surface 31*a*3. The movable range of the wheelchair at the middle portion 42*b* of the lane 42 is the narrowest, and the width of the lane 42 at the middle portion 42*b* is equal to the width W3. The movable range of the wheelchair at the first portion 42*a* of the lane 42 or at the second portion 42*c* thereof is wider than that at the middle portion 42*b*, and the width of the lane 42 at the first portion 42*a* or at the second portion 42*c* is increased to a width "W4" that is greater than the width W3 by about 20 cm as shown in FIG. 5.

For the above reasons, the margin width (or the difference between the width W3 of the lane 42 at the middle portion 42*b* and a width "W10" of the wheelchair) for the check-out facility of FIG. 5 can be reduced to a width below the margin width of about 200 mm in the case of the conventional check-out facility of FIG. 2B. For example, the margin width for the check-out facility of FIG. 5 can be set at about 100 mm. Even when the margin width for the check-out facility 40 of FIG. 5 is set at this level (half the margin width for the conventional check-out facility), a disabled person in a wheelchair can smoothly pass through the access lane 42. Therefore, the width W3 of the access lane 42 can be reduced to a width smaller than the width W2 of the access lane 17 in the conventional check-out facility of FIG. 2B without causing inconvenience to a disabled person in a wheelchair.

Next, a description will be given of features and advantages of the check-out facility 40 when it is used by a disabled person in a wheelchair.

(1) Access

The first side surface 31*a*1 of the side frame 31 on the entrance side of the check-out counter 30 is inwardly inclined, the width W4 of the lane 42 at the first portion 42*a* thereof is relatively large, and the radius R of the corner 32*c* of the top plate 32, confronting the entrance part of the lane 42, is enlarged to about 20 cm. It is possible that a disabled person in a wheelchair can easily enter the lane 42 without interference with the corner 32*c* of the check-out counter 30 by taking a course as indicated by a line 50 in FIG. 5. It is not necessary for the disabled person to take a circuitous course to enter the lane 42. The check-out counter 30 is effective in providing increased accessibility for a disabled person in a wheelchair.

When the disabled person carries a shopping bag, the wheelchair can be placed beneath or pass under the top plate 32 at the entrance-side end of the side frame 31, so that the disabled person can easily put the shopping bag on the top plate 32.

(2) Passing

The middle side surface 31*a*2 has the width "b" in the longitudinal direction of the counter 30 and it is flat and parallel with the second end surface 32*b* of the top plate 32. The middle side surface 31*a*2 extends in parallel to the lane 42. When a disabled person in a wheelchair passes through the access lane, this configuration of the side frame 31 helps the disabled person visually check if the width of the access lane at the position of the middle side surface 31*a*2 is adequate for the wheelchair to pass through the access lane. The check-out counter 30 is effective in providing a feeling of being safe to the disabled person when passing through the lane 42.

The rubber guard 34 is provided at the lower half of the side portion 31*a* of the side frame 31, and the rubber guard 34 extends along the entire periphery of the lower half of the side portion 31*a*. The rubber guard 34 is at a position that is level with or in conformity with the position of the wheelchair. The rubber guard 34 protects the wheelchair from damage if the wheelchair hits the side frame 31 of the check-out counter 30. The check-out counter 30 is effective in providing a feeling of being safe to the disabled person when passing through the lane 42.

(3) Accounting or check-out

The customer display 33*c* in the check-out counter 30 is at the position "H1" lower than the position of the customer display in the conventional check-out counter 10, and the position H1 of the customer display 33*c* in the check-out counter 30 is in conformity with the position of a disabled person in a wheelchair. Thus, the disabled person can easily see the customer display 33*c* of the accounting terminal 33 from the position in the wheelchair, and the disabled person can easily check the amount charged for the goods bought.

The cash container 33*d* in the check-out counter 30 is at the position "H2" lower than the position of the cash container in the conventional check-out counter 10. The position H2 of the cash container 33*d* in the check-out counter 30 is in conformity with the position of a disabled person in a wheelchair. Thus, the disabled person can easily place money on or receive change from the cash container 33*d* in the check-out counter 30.

(4) Leaving

The second side surface 31*a*3 of the side frame 31 on the exit side of the check-out counter 30 is inwardly inclined, the width W4 of the lane 42 at the second portion 42*c* thereof is relatively large, and the wheelchair can be placed beneath or pass under the top plate 32 at the exit-side end of the side frame 31. It is possible that a disabled person in a wheelchair can easily leave the lane 42 without interference with the check-out counter 30. The check-out counter 30 is effective in providing increased convenience to the disabled person.

If the shopping bag is put on the top plate 32, the wheelchair can be placed beneath or pass under the top plate 32 at the exit-side end of the side frame 31, so that the disabled person can easily take the shopping bag from the top plate 32 after the accounting or check-out is finished.

Figure 6:
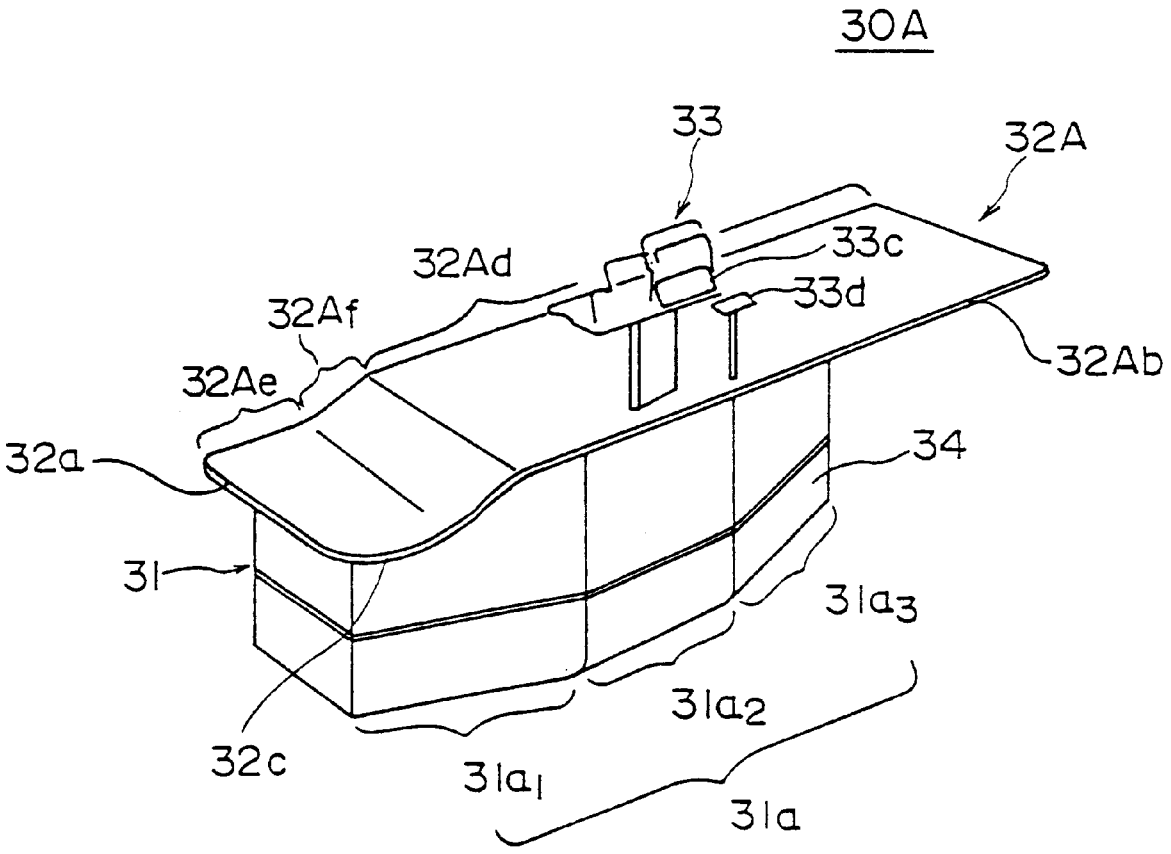
FIG. 6 is a perspective view of a second embodiment of the check-out counter of the present invention.

Next, FIG. 6 shows a second embodiment of the check-out counter of the present invention. In FIG. 6, the elements which are the same as corresponding elements in FIG. 3 are designated by the same reference numerals, and a duplicate description thereof will be omitted.

As shown in FIG. 6, in the check-out counter 30A of the present embodiment, only the top plate 32 in the check-out counter 30 is modified and a different top plate 32A is provided.

The top plate 32A in the present embodiment includes a main plate portion 32A*d* which is essentially the same as a corresponding portion of the top plate 32 in the embodiment of FIG. 3. The main plate portion 32A*d* has an entrance-side end located near the entrance-side end of the side frame 31. The top plate 32A includes the first end surface 32*a* and a lowered plate portion 32A*e* at the entrance-side end of the side frame 31. The top plate 32A includes a sloped portion 32A*f* provided between the main plate portion 32A*d* and the lowered plate portion 32A*e*, and the sloped portion 32A*f* interconnects the entrance-side end of the main plate portion 32A*d* and the lowered plate portion 32A*e*.

Further, the top plate 32A includes a second end surface 32A*b* extending in a longitudinal direction of the check-out counter 30A but the second end surface 32A*b* is lowered at its entrance side in conformity with the lowered plate portion 32A*e*. The top plate 32 includes the circular rounded corner 32*c* confronting the entrance part of the access lane, and the corner 32*c* interconnects the first end surface 32*a* and the second end surface 32A*b*. The corner 32*c* in the present embodiment is the same as the corner 32*c* in the embodiment of FIG. 3 and it has the radius "R" of about 20 cm.

Other elements in the check-out counter 32A are the same as corresponding elements in the embodiment of FIG. 3.

In a case of the check-out counter 30A, when a disabled person in a wheelchair carries a shopping bag, the disabled person can more easily put the shopping bag on the lowered plate portion 32A*e* of the top plate 32A with no need for placing the wheelchair beneath or passing under the top plate 32A at the entrance-side end of the counter 30A. As the shopping bag on the lowered plate portion 32A*e* is easily moved up to the main plate portion 32A*d* via the sloped portion 32A*f* by the check-out operator, the disabled person can easily take the shopping bag from the top plate 32A after the accounting is finished.

Figure 7A:
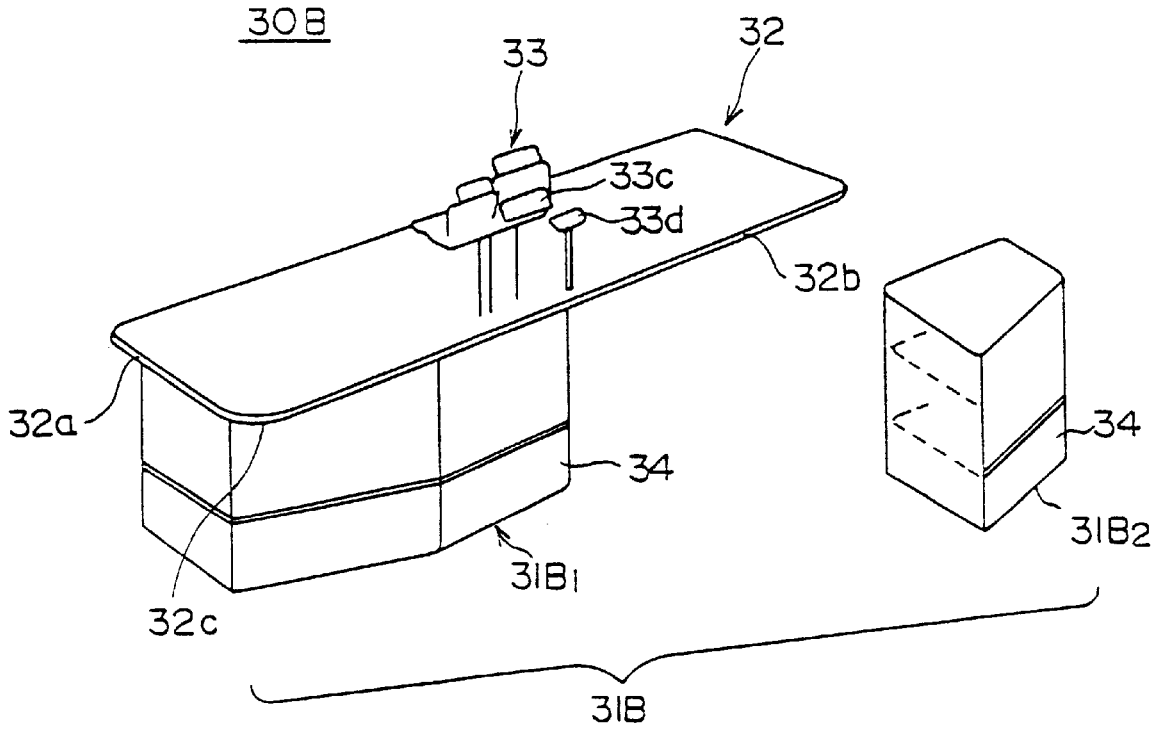
FIG. 7A and FIG. 7B are perspective views of a third embodiment of the check-out counter of the present invention.
Figure 7B:
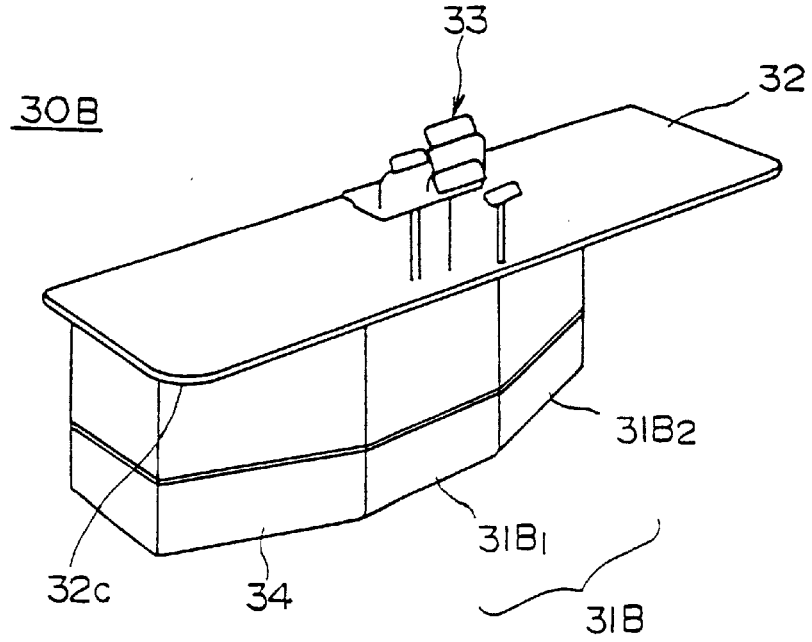

Next, FIG. 7A and FIG. 7B show a third embodiment of the check-out counter of the present invention. In FIG. 7A and FIG. 7B, the elements which are the same as corresponding elements in FIG. 3 are designated by the same reference numerals, and a duplicate description will be omitted.

As shown in FIG. 7A and FIG. 7B, in the check-out counter 30B of the present embodiment, only the side frame 31 in the check-out counter 30 is modified and a different side frame 31B is provided.

The side frame 31B in the present embodiment includes a main side frame 31B1 which is essentially the same as a corresponding portion of the side frame 31 in the embodiment of FIG. 3. The main side frame 31B1 is fixed to the top plate 32 and includes the first side surface 31*a*1 and the middle side surface 31*a*2 as in the side frame 31 shown in FIG. 3. A size of the main side frame 31B1 is approximately two thirds of the size of the side frame 31 of FIG. 3, and the check-out counter 30B with only the main side frame 31B1 stably sits on the floor.

The side frame 31B in the present embodiment includes a separate side frame 31B2 which is separated from the main side frame 31B1 and not fixed to the top plate 32. As shown in FIG. 7B, the separate side frame 31B2 is provided on the exit side of the check-out counter 30B as required, so that it is connected with the main side frame 31B1 to form the side frame 31B. The separate side frame 31B2 includes only the second side surface 31*a*3 as in the side frame 31 of FIG. 3, and a size of the separate side frame 31B2 is approximately one third of the side frame 31 of FIG. 3.

Other elements in the check-out counter 32B are the same as corresponding elements in the embodiment of FIG. 3.

In the check-out counter 30B of the present embodiment, the separate side frame 31B2 is attachable to the main side frame 31B1 at any time to form the check-out counter 30B. The check-out counter 30B wherein the separate side frame 31B2 is removed and only the main side frame 31B1 is included, is lighter in weight than the check-out counter 30. As the separate side frame 31B2 can be connected with the main side frame 31B1 later, it is possible to more easily install the check-out counter 30B in the internal area of the store than the check-out counter 30 of the embodiment of FIG. 3. Also, setting up or displacement of the check-out counter 30B can be easily carried out by removing the separate side frame 31B2.

In addition, the check-out counter 30B wherein the separate side frame 31B2 is removed and only the main side frame 31B1 is included, may be used in the store. As described above, the check-out counter 30B with only the main side frame 31B1 stably sits on the floor.

The check-out counters 30A and 30B of the above-described embodiments may be used in a check-out facility in the same manner as in the check-out facility 40 shown in FIG. 5.

Further, the present invention is not limited to the above-described embodiments, and variations and modifications may be made without departing from the present invention.

What is claimed is:

1. A check-out counter accessible to both physically disabled persons in a wheelchair and persons not physically disabled comprising:

a floor supported side frame having an entrance side surface, an exit side surface and a middle surface between the entrance side surface and the exit side surface, with the middle surface in a substantially longitudinal direction and the entrance side surface and the exit side surface angled from the middle surface in a direction away from the middle surface;

a top plate supported by the side frame and arranged parallel with the longitudinal direction of the middle surface of the side frame, the top plate extending over the side frame such that space is created under the top plate at least in front of the entrance side surface and the exit side surface, said space suitable for passing a side of a wheelchair under the top plate; and an accounting terminal on the top plate.

2. The check-out counter according to claim 1, wherein the top plate has a rounded corner above the entrance side surface of the side frame.

3. The check-out counter according to claim 2, wherein the rounded corner has a radius of 20 cm.

4. The check-out counter according to claim 1, wherein said accounting terminal has a customer display provided at a position that is viewable by a physically disabled person in a wheelchair.

5. The check-out counter according to claim 1, wherein said accounting terminal has a cash container provided at a position reachable by a physically disabled person in a wheelchair.

6. The check-out counter according to claim 1, wherein said side frame has a rubber guard extending along an entire periphery of the lower half of the side frame.

7. A check-out counter accessible to both physically disabled persons in a wheelchair and persons not physically disabled comprising:

a floor supported side frame having an entrance side surface, an exit side surface and a middle surface between the entrance side surface and the exit side surface, with the middle surface in a substantially longitudinal direction and the entrance side surface and the exit side surface angled from the middle surface in a direction away from the middle surface;

a top plate supported by the side frame and arranged parallel with the longitudinal direction of the middle surface of the side frame, said top plate includes a main plate portion, a lowered plate portion at an end near the entrance side surface lower in height than the main plate portion, and a sloped portion connecting the main plate portion and the lowered plate portion and said top plate extends over the side frame such that space is created under the top plate at least in front of the entrance side surface and the exit side surface, said space suitable for passing a side of a wheelchair under the top plate; and an accounting terminal on the top plate.

8. The check-out counter according to claim 7, wherein the top plate has a rounded corner above the entrance side surface of the side frame.

9. The check-out counter according to claim 8, wherein the rounded corner has a radius of 20 cm.

10. The check-out counter according to claim 7, wherein said accounting terminal has a customer display provided at a position that is viewable by a physically disabled person in a wheelchair.

11. The check-out counter according to claim 7, wherein said accounting terminal has a cash container provided at a position reachable by a physically disabled person in a wheelchair.

12. The check-out counter according to claim 7, wherein said side frame has a rubber guard extending along an entire periphery of the lower half of the side frame.

13. A check-out counter accessible to both physically disabled persons in a wheelchair and persons not physically disabled comprising:

a floor supported side frame further comprising, a first member having an entrance side surface and a middle surface, with the middle surface in a substantially longitudinal direction and the entrance side surface angled from the middle surface in a direction away from the middle surface, and a second member having an exit side surface, with the exit side surface angled from the middle surface of the first member in a direction away from the middle surface, wherein the second member can be optionally removed from the side frame or added to the side frame;

a top plate supported by the side frame and arranged parallel with the longitudinal direction of the middle surface of the side frame, the top plate extending over the side frame such that space is created under the top plate at least in front of the entrance side surface and the exit side surface, said space suitable for passing a side of a wheelchair under the top plate; and an accounting terminal on the top plate.

14. The check-out counter according to claim 13, wherein the top plate has a rounded corner above the entrance side surface of the side frame.

15. The check-out counter according to claim 14, wherein the rounded corner has a radius of 20 cm.

16. The check-out counter according to claim 13, wherein the top plate includes a main plate portion, a lowered plate portion at an end near the entrance side surface lower in height than the main plate portion, and a sloped portion connecting the main plate portion and the lowered plate portion.

17. The check-out counter according to claim 13, wherein said accounting terminal has a customer display provided at a position that is viewable by a physically disabled person in a wheelchair.

18. The check-out counter according to claim 13, wherein said accounting terminal has a cash container provided at a position reachable by a physically disabled person in a wheelchair.

19. The check-out counter according to claim 13, wherein said side frame has a rubber guard extending along an entire periphery of the lower half of the side frame.

20. A plurality of check-out counters accessible to both physically disabled persons in a wheelchair and persons not physically disabled, each check-out counter comprising:

a floor supported side frame having an entrance side surface, an exit side surface and a middle surface between the entrance side surface and the exit side surface, with the middle surface in a substantially longitudinal direction and the entrance side surface and the exit side surface angled from the middle surface in a direction away from the middle surface;

a top plate supported by the side frame and arranged parallel with the longitudinal direction of the middle surface of the side frame, the top plate extending over the side frame such that space is created under the top plate at least in front of the entrance side surface and the exit side surface, said space suitable for passing a side of a wheelchair under the top plate; and an accounting terminal on the top plate;

whereby said plurality of check-out counters are placed next to each other in a parallel arrangement and the length of the parallel arrangement of said plurality of check-out counters is substantially less than the length of a plurality of check-out counters without said side frame and said top plate extending over said side frame.

* * * * *